United States Patent [19]

Harrison

[11] Patent Number: 4,999,958

[45] Date of Patent: Mar. 19, 1991

[54] WINDOW ASSEMBLIES

[75] Inventor: Ian Harrison, Barnsley, Great Britain

[73] Assignee: John Carr (Press Lock) Limited, Yorkshire, Great Britain

[21] Appl. No.: 473,978

[22] PCT Filed: Oct. 28, 1988

[86] PCT No.: PCT/GB88/00933

§ 371 Date: Apr. 20, 1990

§ 102(e) Date: Apr. 20, 1990

[87] PCT Pub. No.: WO89/03924

PCT Pub. Date: May 5, 1989

[30] Foreign Application Priority Data

Oct. 28, 1987 [GB] United Kingdom ..... 8725270

[51] Int. Cl.[5] ..... E04C 3/66

[52] U.S. Cl. ..... 52/214; 52/215; 52/399; 52/656; 49/490; 49/455

[58] Field of Search ..... 52/204, 208, 213–215, 52/399, 656, 775; 49/453, 455, 490, 491

[56] References Cited

U.S. PATENT DOCUMENTS

| | | | |
|---|---|---|---|
| 1,570,351 | 1/1926 | Hultin | 52/214 |
| 2,288,548 | 6/1942 | Peremi et al. | 52/215 X |
| 2,696,280 | 12/1954 | Bourne et al. . | |
| 2,902,727 | 9/1959 | Samolis | 52/214 X |
| 2,996,767 | 8/1961 | Kobil et al. | 52/214 X |
| 3,016,996 | 1/1962 | Smathers et al. | 52/215 |
| 3,141,205 | 7/1964 | Russell | 52/213 X |
| 3,156,331 | 11/1964 | Sklar | 52/215 |
| 3,363,365 | 1/1968 | Laepple | 52/213 X |
| 4,570,399 | 2/1986 | Wentink | 52/208 |
| 4,726,148 | 2/1988 | Tix | 52/213 X |

FOREIGN PATENT DOCUMENTS

| | | |
|---|---|---|
| 2330448 | 1/1975 | Fed. Rep. of Germany . |
| 2026384 | 9/1970 | France . |
| 7806419 | 12/1979 | Netherlands . |
| 8301027 | 10/1984 | Netherlands . |
| 240629 | 9/1924 | United Kingdom . |

*Primary Examiner*—Richard E. Chilcot, Jr.

*Attorney, Agent, or Firm*—Fay, Sharpe, Beall, Fagan, Minnich & McKee

[57] ABSTRACT

A window assembly comprises a rigid first frame (1) defining an opening; and a glazed second frame (9) adapted to be fitted into and close off the opening in the first frame (1), the second frame (9) being of a plastics material and having a resilient part (27) integral therewith which permits the second frame (9) to be moved in one direction into the opening and thereafter coacts with the first frame (1) to prevent the second frame (9) from being withdrawn from the first frame (1) in the direction which is opposite to the first direction. There is provided a method of glazing a window opening within a building which comprises applying a first metal frame (1) having a channel section and generally rectangular perimeter to a window opening during the course of erection of the building, securing the said first frame (1) to the building structure adjacent it (with or without a sill (3) between one part of the first frame (1) and the lower surface of the window opening) during erection of the building then subsequently applying a glazed second frame (9) having retaining means (27) to the first frame (1) such that the retaining means (27) are caused to engage the first frame (1) to securely attach said second frame (9) to the first frame (1), and prevent separation thereof in a direction opposite to that of installation.

6 Claims, 3 Drawing Sheets

WINDOW ASSEMBLIES

This invention relates to window assemblies

The conventional window assembly which has been in use for many years comprises a wooden or metal frame which is incorporated in the masonry of a building as it is constructed. Glass is subsequently fitted into the frame and it is held in position by putty or the like.

It is an object of the present invention to provide an improved form of window assembly.

According to the present invention, a window assembly comprises a rigid first frame defining an opening; and a glazed second frame adapted to be fitted into and close off the opening in the first frame, the second frame being of a plastics material and having a resilient part integral therewith which permits the second frame to be moved in one direction into the opening and thereafter coacts with the first frame to prevent the second frame from being withdrawn from the first frame in the direction which is opposite to the first direction.

According to another aspect of this invention there is provided a method of glazing a window opening within a building which comprises applying a first metal frame having a channel section and generally rectangular perimeter to a window opening during the course of erection of the building, securing the said first frame to the building structure adjacent it (with or without a sill between one part of the first frame and the lower surface of the window opening) during erection of the building then subsequently applying a glazed second frame having retaining means to the first frame such that the retaining means are caused to engage the first frame to securely attach said second frame to the first frame, and prevent separation thereof in a direction opposite to that of installation.

The fitting of the glazed second frame into the opening of the first frame is brought about in a very simple manner and this has a considerable time saving over the conventional window assembly.

Preferably, the rigid first frame is incorporated in a building structure as the structure is constructed. This is a desirable mode of construction for the builder who positions the frame on previously laid brickwork or the like and lays further masonry around the frame until it is fully incorporated in the building structure. At this stage, the second frame has not been fitted into the first frame and, consequently, there is no danger of the second frame and the glass being damaged.

The second frame is preferably manufactured from PVC while the first frame is preferably of metal, e.g. galvanised steel. The first frame is preferably of or includes channel section(s).

In order that the invention may be more readily understood, it will now be described, by way of example only, with reference to the accompanying drawings illustrating a preferred embodiment and in which.

Figure 1:
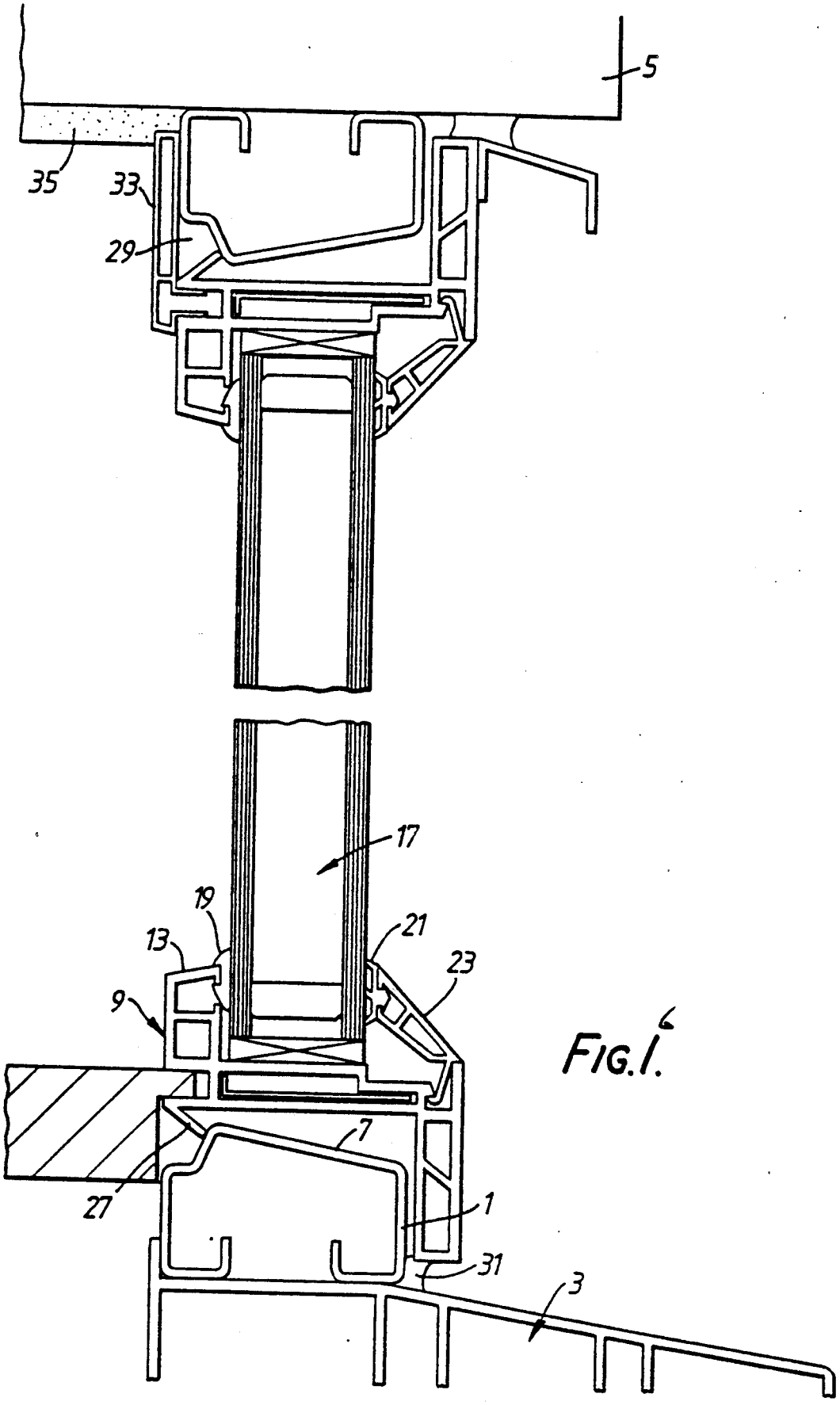
FIG. 1 is a vertical section through a window assembly according to the present invention.
Figure 2:
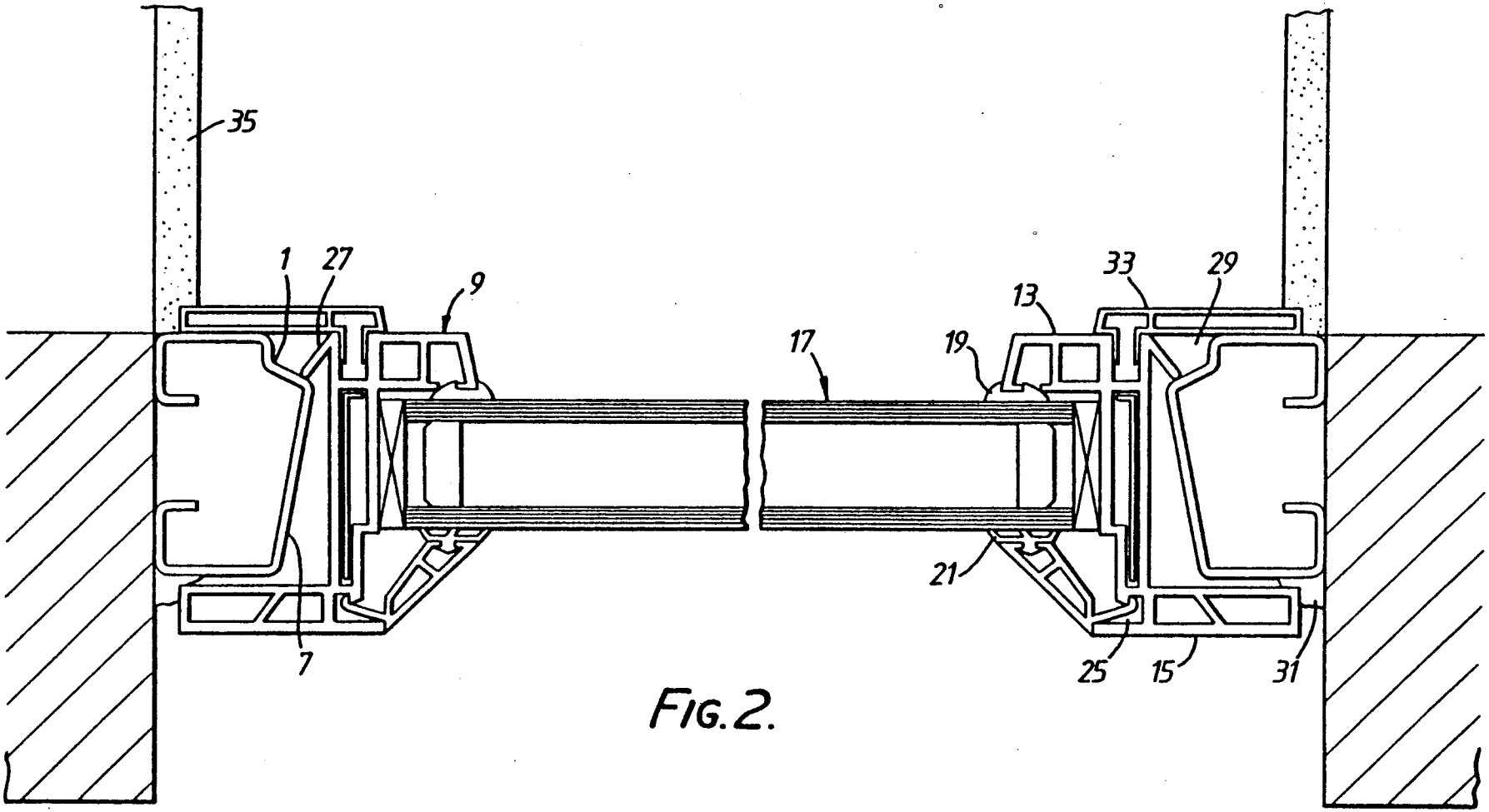
FIG. 2 is a horizontal section through the window assembly to the present invention.

In FIGS. 1 and 2, a window assembly is shown fitted in a building structure.

During the building of the structure, whether it be of bricks, blocks, stone, or other masonry, a rigid galvanised steel frame 1 is incorporated in the structure and is held in place by ties and the like (not shown) which tie into the masonry. A PVC sill 3 is conveniently positioned beneath the frame and a lintel 5 is positioned above the frame. The frame 1 is of generally rectangular cross-section and has a surface 7 which defines the opening through the frame. This surface is inclined such that the cross-section of the opening at one side of the frame is greater than at the opposite side of the frame. The frame is incorporated in the building structure so that the side having the larger opening is at the outside of the building.

Figure 3:
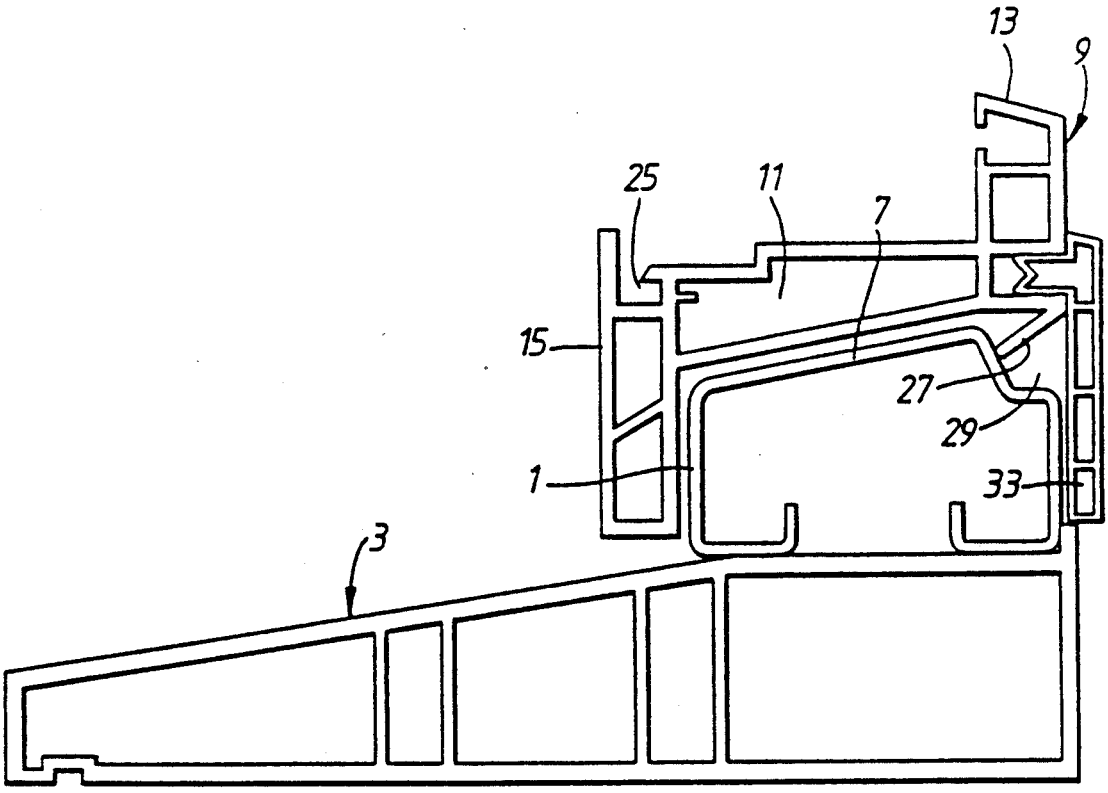
FIG. 3 is a vertical section, to an enlarged scale, of part of the assembly shown in FIG. 1.

A second frame 9, shown in greater detail in FIG. 3, is of extruded PVC and has a first part 11, and additional parts 13, 15 which extend in opposite directions and generally at right angles to the part 11. The frame has a double glazed unit 17 fitted into it with a sealing strip 19 positioned between the unit 19 and the part 13 of the frame. A sealing strip 21 is positioned between the opposite side of the glazed unit and a PVC clip 23 which clips into a recess 25 on the frame to hold the glazed unit in position in the frame.

The part 11 of the frame includes a resilient tongue 27.

The previously glazed frame 9 is introduced into the outer frame 1 from the outside of the building. The resilient tongue moves along the inclined surface 7 of the frame 1 and in doing so it is deflected towards the part 11 of the frame. The frame 1 has a recessed portion 29 and, when the frame 9 is in the correct position within the frame 1, the tongue 27 moves back away from the part 11 into the recessed portion 29 of the frame 1 and prevents the frame 9 from being withdrawn back out of the frame 1. The part 15 of the frame 9 abuts against the frame 1 and prevents the frame 9 from moving further relative to the frame 1. Thus, the frame 9 together with the glazed unit 17 is held firmly in position in the frame 1.

A seal 3 of silicone mastik is placed around the frame 1 prior to fitting of the frame so that, when the glazed frame is fitted in position, the mastik seals with the outer edge of the part 15 of the frame.

Finally, a sealing strip 33 is clipped into position on the frame 17 to close off the recess 29 in the frame 1 and the outer end of the sealing strip is embedded in a plaster layer 35 applied to the masonry surrounding the frame.

I claim:

1. A window assembly comprising a rigid first frame defining an opening, the first frame having an inclined surface whereby the cross section of the opening at one side of that frame is greater than the cross section of the side opposite thereto; and a glazed second frame adapted to be fitted into and close off the opening in the first frame, the second frame being of a plastics material and having a resilient part integral therewith which permits the second frame to be moved in one direction into the opening and thereafter coacts with the first frame to prevent the second frame from being withdrawn from the first frame in the direction which is opposite to the first direction.

2. The window assembly of claim 1 wherein the second frame includes a resilient tongue capable of bearing against said inclined surface of the first frame during insertion and of abutting a recessed part of the first frame to resist withdrawal of the second frame from the first frame after full insertion.

3. The window assembly of claim 1 wherein the second frame has a first part adapted to bear against a surface of the first frame during insertion thereof and glazing location parts capable of securely retaining glazing within the perimeter of the said second frame.

4. The window assembly of claim 1 further including a sealing strip engaging the second frame and concealing the joint between first and second frames and concealing a side part of the first frame.

5. A method of glazing a window opening within a building which comprises applying to a window opening, during erection of the building a first rigid frame defining an opening, said first frame having an inclined surface whereby the cross section of the opening at one side of that frame is greater than the cross section of the side opposite thereto, securing the said first frame to the building structure adjacent it and subsequently fitting a glazed second frame into the opening defined by the second frame, the second frame being of a plastics material and having a resilient part integral therewith which permits the second frame to be moved in one direction into the opening and thereafter coacts with the first frame to prevent the second frame from being withdrawn from the first frame in the direction which is opposite to the first direction.

6. The method of claim 5 as applied to the installation of a window assembly as claimed in claim 1.

* * * * *